US010919739B2

(12) United States Patent
Furuichi

(10) Patent No.: US 10,919,739 B2
(45) Date of Patent: Feb. 16, 2021

(54) OVERLOAD PREVENTING DEVICE

(71) Applicant: TADANO LTD., Kagawa (JP)

(72) Inventor: Kazuhiro Furuichi, Kagawa (JP)

(73) Assignee: TADANO LTD., Kagawa (JP)

( * ) Notice: Subject to any disclaimer, the term of this patent is extended or adjusted under 35 U.S.C. 154(b) by 0 days.

(21) Appl. No.: 16/635,926

(22) PCT Filed: Aug. 1, 2018

(86) PCT No.: PCT/JP2018/028767
§ 371 (c)(1),
(2) Date: Jan. 31, 2020

(87) PCT Pub. No.: WO2019/031320
PCT Pub. Date: Feb. 14, 2019

(65) Prior Publication Data

US 2020/0231418 A1 Jul. 23, 2020

(30) Foreign Application Priority Data

Aug. 8, 2017 (JP) ..... JP2017-153646

(51) Int. Cl.
*B66C 23/42* (2006.01)
*B66C 23/78* (2006.01)
(Continued)

(52) U.S. Cl.
CPC ..... *B66C 23/905* (2013.01); *B66C 23/42* (2013.01); *B66C 23/78* (2013.01); *B66C 2700/0371* (2013.01)

(58) Field of Classification Search
CPC ..... B66C 23/00; B66C 23/36; B66C 23/42; B66C 23/78; B66C 23/88; B66C 23/905;
(Continued)

(56) References Cited

U.S. PATENT DOCUMENTS 6,170,681 B1 1/2001 Yoshimatsu
7,672,768 B2 * 3/2010 Narisawa ..... B66C 23/905 340/438
(Continued)

FOREIGN PATENT DOCUMENTS

DE 102012011871 A1 12/2013
EP 0420625 A2 4/1991
(Continued)

OTHER PUBLICATIONS

Oct. 23, 2018, International Search Report issued for related PCT Application No. PCT/JP2018/028767.
(Continued)

*Primary Examiner* — Yonel Beaulieu
(74) *Attorney, Agent, or Firm* — Paratus Law Group, PLLC

(57) ABSTRACT

This overload preventing device is mounted on a mobile work machine, and is provided with: a storage unit which stores lifting performance data in which lifting performance is configured for each operation state, and performance region data in which switching angles are configured that define performance regions, including a front region, a back region, and a side region; and a work machine control unit which controls operation of the mobile work machine on the basis of the actual load and the lifting performance corresponding to the present operation state of the mobile work machine. The lifting performance includes a maximum deployment width performance configured for the front region and the back region, and the switching angles are configured for each operation state on the basis of stability calculations and strength factors such as jack strength.

5 Claims, 9 Drawing Sheets

(51) Int. Cl.

| | |
|---|---|
| ***B66C 23/90*** | (2006.01) |
| ***B66C 13/00*** | (2006.01) |
| ***B66C 13/04*** | (2006.01) |
| ***B66C 13/06*** | (2006.01) |
| ***B66C 13/46*** | (2006.01) |
| ***B66C 15/02*** | (2006.01) |

(58) Field of Classification Search
CPC ..... B66C 15/00; B66C 15/02; B66C 13/00; B66C 13/04; B66C 13/46; B66C 23/90; B66C 2700/00; B66C 2700/011
See application file for complete search history.

(56) References Cited

U.S. PATENT DOCUMENTS

| | | | | |
|---|---|---|---|---|
| 10,414,635 | B2 * | 9/2019 | Hayashi | B66C 13/44 |
| 2005/0192732 | A1 * | 9/2005 | Narisawa | B66C 23/905 701/50 |
| 2017/0036894 | A1 | 2/2017 | Braun et al. | |
| 2018/0148303 | A1 * | 5/2018 | Hayashi | B66C 13/44 |
| 2018/0282131 | A1 * | 10/2018 | Hayashi | B66C 13/40 |

FOREIGN PATENT DOCUMENTS

| | | | |
|---|---|---|---|
| EP | 0539207 | A1 | 7/1995 |
| EP | 2692684 | A1 | 2/2014 |
| JP | H09-020500 | A | 1/1997 |
| JP | 2010-044177 | A | 2/2010 |
| JP | 2010-120753 | A | 6/2010 |
| JP | 2014-031223 | A | 2/2014 |
| WO | WO 2017/063014 | A1 | 4/2017 |

OTHER PUBLICATIONS

Oct. 23, 2018, International Search Opinion issued for related PCT Application No. PCT/JP2018/028767.
Aug. 6, 2019, Japanese Notice of Reasons for Refusal issued for related JP Application No. 2017-153646.
Oct. 23, 2019, Japanese Decision to Grant a Patent issued for related JP Application No. 2017-153646.
Jul. 24, 2020, European Search Report issued for related EP application No. 18843905.3.

* cited by examiner

--Prior Art--

--Prior Art--

--Prior Art--

CW: LARGE/BOOM: SHORT

CW: SMALL/BOOM: SHORT

CW: LARGE/BOOM: LONG

CW: SMALL/BOOM: LONG

OVERLOAD PREVENTING DEVICE

CROSS REFERENCE TO PRIOR APPLICATION

This application is a National Stage Patent Application of PCT International Patent Application No. PCT/JP2018/028767 (filed on Aug. 1, 2018) under 35 U.S.C. § 371, which claims priority to Japanese Patent Application No. 2017-153646 (filed on Aug. 8, 2017), which are all hereby incorporated by reference in their entirety.

TECHNICAL FIELD

The present invention relates to an overload preventing device which is mounted in a mobile work machine.

BACKGROUND ART

A mobile work machine (hereinbelow, referred to "work machine") such as a mobile crane and a high-place work vehicle is provided with plural outriggers (for example, a total four outriggers two by two on the front and rear sides) to secure stability during work. In principle, an operation is performed in a state where the outriggers overhang at maximum. However, it is allowed that the overhanging widths of the outriggers are set differently (different state) depending on an installation place of the work machine.

In addition, a safety device is required to be attached to the work machine in order to safely perform the work. As one example of the safety device, an overload preventing device (moment limiter) is used to limit the operation of the work machine to a dangerous side (for example, derricking and turning of the boom) in an overload state or to notify that the state is close to the overload state. According to the overload preventing device, it is possible to prevent in advance an accident such as the falling or the damage of the work machine due to an overload exceeding the lifting performance (typically, a rated total load).

The rated total load is a maximum load (including the mass of a lifting tool) that can be loaded on the work machine, and is set for each operation state (for example, a boom length, a work radius, an overhanging state of the outriggers, and a slewing angle) on the basis of stability of the work machine or a strength of the structure (for example, boom and a jack of the outrigger).

In the following description, the states when the outrigger is a maximum overhanging width, a minimum overhanging width, and an intermediate overhanging width (an overhanging width in the middle of the maximum overhanging width and the minimum overhanging width) will be referred to as "maximum overhanging state", "minimum overhanging state", and "intermediate overhanging state" respectively.

Herein, the rated total load (particularly, a rated total load based on stability) is actually different depending on the slewing angle of the boom. However, from the viewpoint of safety and convenience, the rated total load is generally set to the same value for each performance region (the front region, the back region, and the side region). Specifically, a load capable of overhanging at a slewing angle (minimum stability direction) at which the stability becomes worst is set as the rated total load. In the following description, in a case where all the outriggers are in the maximum overhanging state, a load capable of overhanging in the minimum stability direction is referred to as "maximum overhanging width performance". In a case where the outriggers are in different states, a load capable of overhanging in the minimum stability direction is referred to as "intermediate overhanging width performance" or "minimum overhanging width performance".

The front region is a performance region in front of the work machine, and a performance region capable of setting the maximum overhanging width performance as the lifting performance. The back region is a performance region on the rear side of the work machine, and similarly to the front region, a region capable of setting the maximum overhanging width performance as the lifting performance. The side region is a performance region other than the front region and the back region.

The overload preventing device refers to, for example, the lifting performance corresponding to the operation state from lifting performance data set for each operation state, and monitors the load state (load rate) of the work machine on the basis of an actual load including the weight of the lifting tool (hereinafter, referred to as "actual load) and the referred lifting performance. In addition, the overload preventing device includes performance region data which defines the front region, the back region, and the side region. The performance region data is set according to the overhanging state of the outrigger.

Hereinbelow, the description will be given about the lifting performance and the performance region of the work machine used in the conventional overload preventing device.

FIG. 1 is a diagram illustrating the lifting performance in a case where the outriggers OR1 to OR4 are in the equal overhanging state. FIG. 1 is a diagram illustrating the lifting performance in a case where four outriggers OR1 to OR4 all are in the maximum overhanging state.

As illustrated in FIG. 1, in a case where the outriggers OR1 to OR4 are in the equal overhanging state, the lifting performance is the same in any of the front region FA, the back region RA, and side regions SA1 and SA2, and the maximum overhanging width performance is set.

FIGS. 2A and 2B are diagrams illustrating the lifting performance in a case where the outriggers OR1 to OR4 are in different states. FIGS. 2A and 2B illustrate the lifting performance in a case where the front outriggers OR1 and OR2 among four outriggers OR1 to OR4 are in the intermediate overhanging state, and the rear outriggers OR3 and OR4 are in the maximum overhanging state.

As illustrated in FIGS. 2A and 2B, in a case where the outriggers OR1 to OR4 are in the different state, the maximum overhanging width performance is set as the lifting performance in the front region FA and the back region RA. On the other hand, in the side regions SA1 and SA2, the minimum overhanging width performance or the intermediate overhanging width performance (the intermediate overhanging width performance in FIGS. 2A and 2B) is set as the lifting performance according to the overhanging state of the outriggers OR1 to OR4. Further, a slewing angle θ at which the front region FA, the back region RA, and the side regions SA1 and SA2 are switched is set as the performance region data.

In other words, in the front region FA and the back region RA, the maximum overhanging width performance is set as the lifting performance regardless of the overhanging states of the outriggers OR1 to OR4, but a slewing angle range which is defined as the front region FA and the back region RA by the overhanging states of the outriggers OR1 to OR4 is different.

Herein, the performance region data, that is, the slewing angle θ (hereinbelow, referred to as "switching angle θ") at which the performance region is switched is obtained by a stability calculation. For example, in a case where the outrigger enters the different state, the stability in all circumferential directions when the maximum overhanging width performance is loaded is obtained. The range where the stability satisfies a predetermined value becomes the front region FA or the back region RA, and other ranges become the side regions SA1 and SA2. The stability is an index indicating stability against the falling of the work machine, and is expressed by, for example, stability moment/falling moment.

In FIGS. 2A and 2B, 305° to 55° (±55° from the front direction (the slewing angle 0°) of the work machine) is the front region FA, 115° to 245° (±65° from the rear direction (the slewing angle 180°) of the work machine) is the back region RA, 55° to 115° is the right side region SA1, and 245° to 305° is the left side region SA2. In other words, in FIGS. 2A and 2B, the performance region is switched using 55°, 115°, 245°, and 305° as the switching angle θ.

In addition, there is proposed a method of calculating the lifting performance corresponding to the present operation state (including the slewing angle) in real time by the overload preventing device, and monitoring the load state (load rate) of the work machine on the basis of the lifting performance obtained by the calculation and the actual load (for example, Patent Literature 1). In this case, it is possible to allow maximum utilization of the performance of the work machine.

CITATION LIST

Patent Literature

Patent Literature 1: DE 102012011871 A1

SUMMARY OF THE INVENTION

Problems to be Solved by the Invention

However, conventionally, the switching angle θ to switch the performance region depends on the overhanging states of the outriggers, and set with the same value if the overhanging states of the outriggers are the same though other operation states are different. Therefore, it cannot be said that the lifting performance of the work machine different in the operation state can be used at maximum.

In addition, in the method disclosed in Patent Literature 1, the calculation load of the overload preventing device is increased in order to calculate the lifting performance according to the slewing angle in real time, and the accuracy of detectors which detect the operation state is easily influenced from disturbance. Therefore, there is a problem in stability.

An object of the invention is to provide an overload preventing device which allows maximum utilization of the lifting performance of a work machine according to the operation state while securing stability.

Solutions to Problems

An overload preventing device according to the invention is mounted in a mobile work machine which includes a travelling body which runs freely, a slewing base disposed on the travelling body to slewing horizontally, a boom disposed on the slewing base to be derricked, and a plurality of outriggers capable of setting an overhanging width in plural stages. The overload preventing device includes a storage unit which stores lifting performance data in which a lifting performance is set for each operation state and performance region data in which a switching angle is set to define a performance region which includes a front region, a back region, and a side region, and a work machine control unit which controls an operation of the mobile work machine on the basis of the lifting performance corresponding to a present operation state of the mobile work machine and an actual load. The lifting performance includes a maximum overhanging width performance which is set to the front region and the back region. The switching angle is set on the basis of a stability calculation and a strength factor such as a jack strength for each operation state.

Effects of the Invention

According to the invention, an overload preventing device is provided which, while ensuring stability, allows maximum utilization of the performance of a work machine in different states of outriggers.

DESCRIPTION OF EMBODIMENTS

Hereinafter, embodiments of the invention will be described in detail with reference to the drawings.

Figure 3:
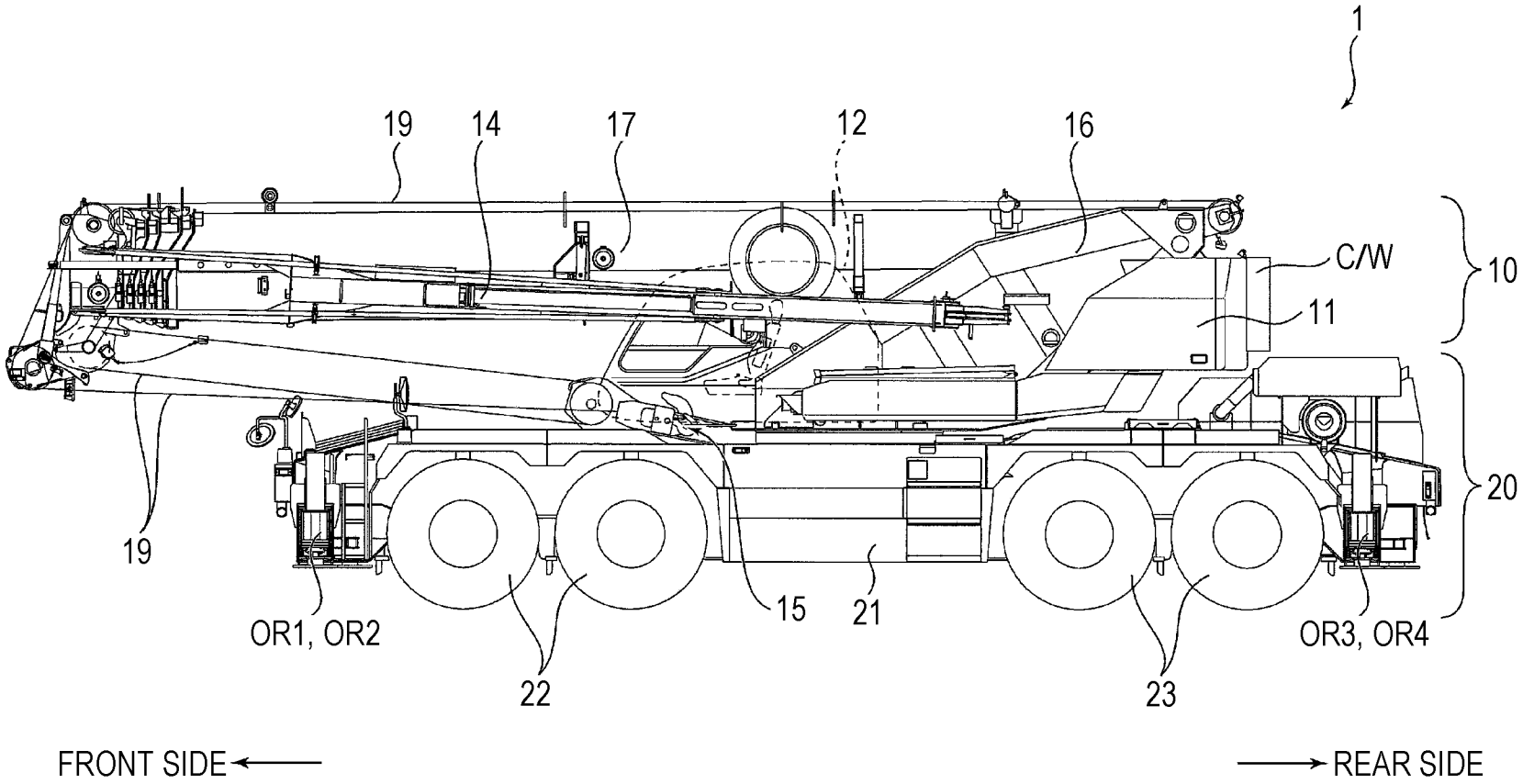
FIG. 3 is a diagram illustrating a state when the mobile work machine according to the embodiment travels.
Figure 4:
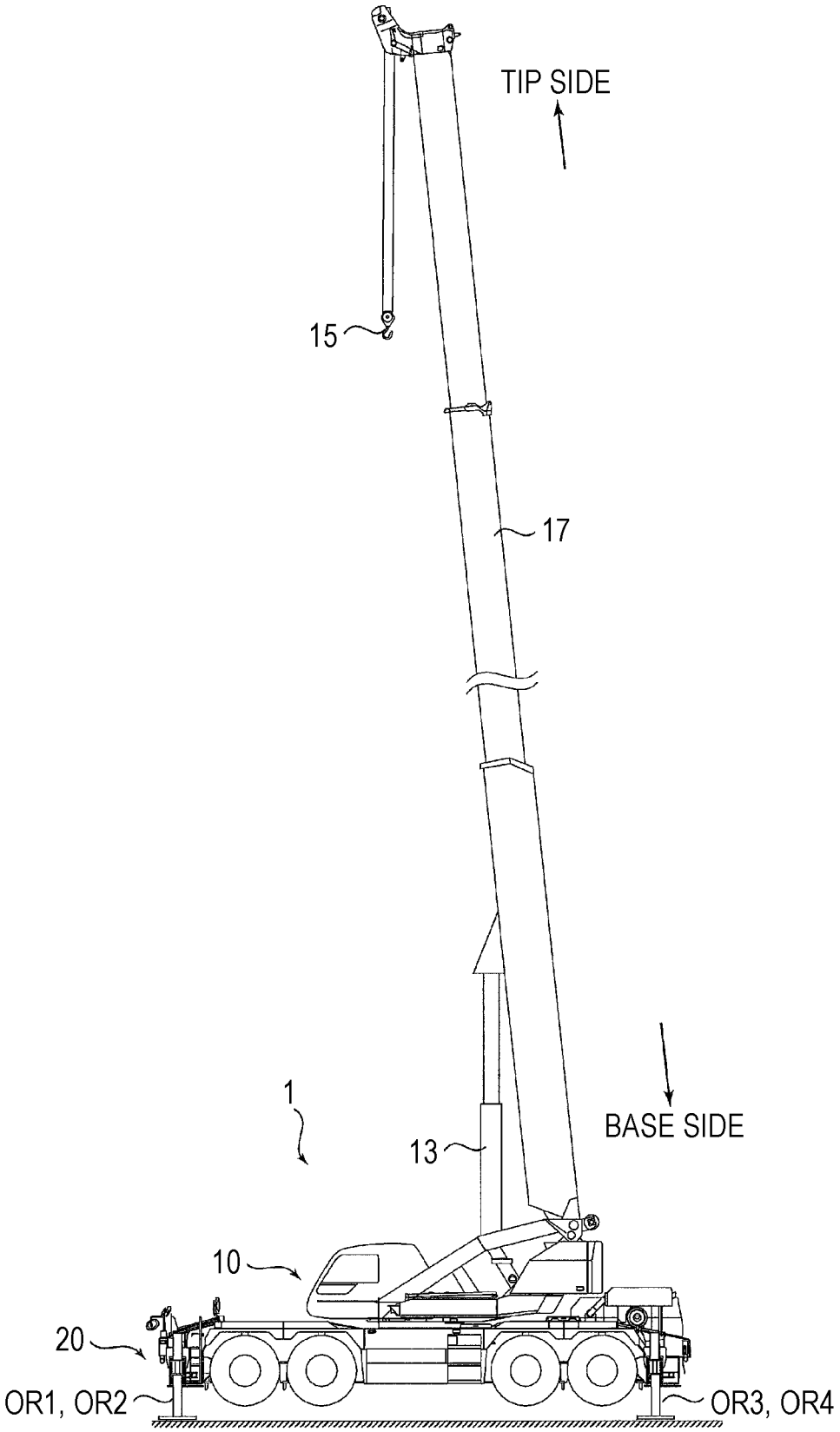
FIG. 4 is a diagram illustrating a state when the mobile work machine works.

FIG. 3 is a diagram illustrating a state when a mobile work machine 1 according to the embodiment of the invention travels. FIG. 4 is a diagram illustrating a state of the mobile work machine 1. The mobile work machine 1 illustrated in FIGS. 3 and 4 is a so-called rough terrain crane (hereinbelow, referred to "work machine 1") which includes an upper slewing body 10 and a lower running body 20.

The work machine 1 is a mobile crane which uses tires for travelling portions of the lower travelling body 20, and can perform a travelling operation and a crane operation from one operation room. An overload preventing device 100 (see FIG. 5) is mounted in the work machine 1 to prevent from entering an overload state.

The upper slewing body 10 includes a slewing frame 11, a cabin 12 (operation room), a derricking cylinder 13, a jib 14, a hook 15, a bracket 16, a telescopic boom 17, a counter weight C/W, and a hoisting device (winch, not illustrated).

The slewing frame 11 is turnably supported to the lower travelling body 20 through a slewing support body (not illustrated). The cabin 12, the derricking cylinder 13, the bracket 16, the telescopic boom 17, the counter weight C/W, and the hoisting device (not illustrated) are attached to the slewing frame 11.

The cabin 12 is disposed in the front portion of the slewing frame 11. In the cabin 12, an operation unit 121, a display unit 122, and a voice output unit 123 (see FIG. 5) are disposed in addition to a seat where an operator sits, and various types of meters.

The telescopic boom 17 is rotatably attached to the bracket 16 through a support shaft (foot pin, symbol omitted). The telescopic boom 17 is configured by 6 stages for example, and includes a base end frame, an intermediate frame (4 stages), and a tip frame in an order from the base end side when being stretched. At the tip of the tip frame, a boom head (symbol omitted) with the sheave (symbol omitted) is disposed. The intermediate frame and the tip frame slides and stretches in the longitudinal direction with respect to the base end frame when a telescopic cylinder (not illustrated) disposed inside stretches (so-called telescopic structure).

Further, the number of intermediate frames is not particularly limited in the telescopic boom 17. In addition, an operation attachment such as a bucket may be attached to the boom head. A boom length of the telescopic boom 17 is, for example, 9.8 m (basic boom length) in a fully stored state, and 44.0 m (maximum boom length) in a fully extended state.

The derricking cylinder 13 is suspended between the slewing frame 11 and the telescopic boom 17. The telescopic boom 17 is derricked by stretching the derricking cylinder 13. A derricking angle of the telescopic boom 17 is, for example, 0° to 84°.

In a case where the lifting height is expanded, the jib 14 is rotatably mounted at the tip (boom head) of the telescopic boom 17. The jib 14 rotates forward to overhang forward from the telescopic boom 17.

The hook 15 is a lifting tool of a key shape, and includes a main hook and an auxiliary hook. The hook 15 is attached to a wire rope 19 which is rolled around the sheave of the tip of the telescopic boom 17 or the tip of the jib 14. The hook 15 rises as the wire rope 19 hoists or dispenses by the hoisting device (not illustrated).

The counter weight C/W is mounted in the rear portion of the slewing frame 11. The counter weight C/W is configured by a combination of a plurality of unit weights. In other words, the counter weight C/W may be set to vary in weight according to a combination of the unit weights.

The lower travelling body 20 includes a vehicle frame 21, a front wheel 22, a rear wheel 23 (hereinbelow, referred to as "wheels 22 and 23"), front outriggers OR1 and OR2, rear outriggers OR3 and OR4 (hereinbelow, referred to as "outriggers OR1 to OR4"), and an engine (not illustrated).

A drive force of the engine is transferred to the wheels 22 and 23 through a transmission (not illustrated). The wheels 22 and 23 are rotated by the drive force of the engine and the work machine 1 travels. In addition, the steering angle (travelling direction) of the wheels 22 and 23 varies according to the operation of a steering wheel (not illustrated) in the cabin 12.

The outriggers OR1 to OR4 are stored in the vehicle frame 21 at the time of travelling. On the other hand, the outriggers OR1 to OR4 overhang in the horizontal direction and the vertical direction at the time of operation (when the upper slewing body 10 operates), and lift up and support the entire vehicle to stabilize the posture. In principle, an operation is performed in a state where the outriggers OR1 to OR4 overhang at maximum. However, it is allowed that the overhanging widths of the outriggers OR1 to OR4 are set differently (different state) depending on an installation place of the work machine. In this embodiment, the outriggers OR1 to OR4 have four stages of the overhanging width (a maximum overhanging width, a first intermediate overhanging width, a second intermediate overhanging width, a minimum overhanging width in an order of width).

Figure 5:
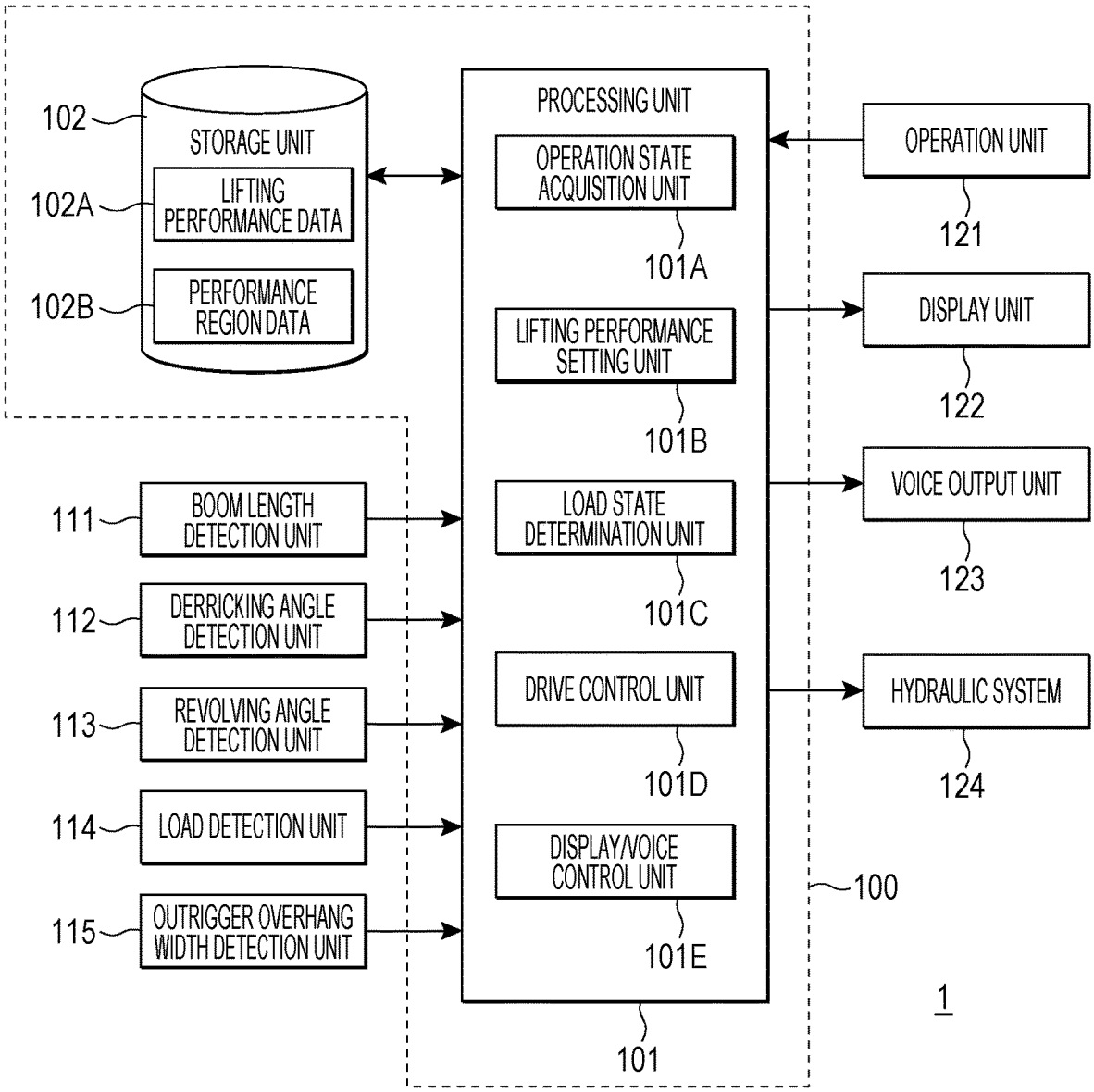
FIG. 5 is a diagram illustrating a control system of the work machine.

FIG. 5 is a diagram illustrating a control system of the work machine 1. As illustrated in FIG. 5, the work machine 1 includes a processing unit 101, a storage unit 102, a boom length detection unit 111, a derricking angle detection unit 112, a slewing angle detection unit 113, a load detection unit 114, an outrigger overhang width detection unit 115, the operation unit 121, the display unit 122, the voice output unit 123, and a hydraulic system 124. The overload preventing device 100 is configured by the processing unit 101 and the storage unit 102.

The overload preventing device 100 prevents the overload in consideration of the stability against the falling of the work machine 1 and the strength of the component. Specifically, in a case where information related to overload prevention (hereinbelow, referred to as "overload prevention information") becomes an overload state, the overload preventing device 100 controls the hydraulic system 124 to restrict the work machine 1 not to make an operation (for example, derricking and slewing of the telescopic boom 17) toward a dangerous side, and notifies that the state is close to the overload state through the display unit 122 and/or the voice output unit 123. Examples of the overload prevention information include the boom length, a boom derricking angle, a work radius, a lifting performance (rated total load), an actual load, the outrigger overhang width, and abnormality information (sensor error). According to the overload preventing device 100, it is possible to prevent in advance an accident such as the falling or the damage of the work machine 1 due to an overload exceeding the lifting performance.

The processing unit 101 includes a Central Processing Unit (CPU) as a calculation/control device, a Read Only Memory (ROM) as a main storage device, and a Random Access Memory (RAM) (not illustrated). In the ROM, a basic program called a Basic Input Output System (BIOS) and basic setting data are stored. The CPU reads a program (for example, an overload preventing program) according to a processing content from the ROM, develops the program in the RAM, and executes the developed program. With this configuration, a predetermined process (for example, an overload preventing process) is realized.

In this embodiment, the processing unit 101 functions as, for example, an operation state acquisition unit 101A, a lifting performance setting unit 101B, a load state determination unit 101C, a drive control unit 101D, and a display/voice control unit 101E by executing the overload preventing program stored in the ROM (not illustrated). The detailed functions of the units will be described later. Further, the operation state acquisition unit 101A, the lifting performance setting unit 101B, the load state determination unit 101C, the drive control unit 101D, and the display/voice control unit 101E form a work machine control unit which controls the operation of the work machine 1 on the basis of the lifting performance according to the present operation state of the work machine 1 and the actual load.

The storage unit 102 is an auxiliary storage device such as a Hard Disk Drive (HDD) or a Solid State Drive (SSD). The storage unit 102 may be a disk drive which reads information by driving an optical disk such as a Compact Disc (CD) and a Digital versatile Disc (DVD) or a magneto-optical disk such as a Magneto-Optical disk (MO), or may be a memory card such as a Universal Serial Bus (USB) memory and a Secure Digital (SD).

The storage unit 102 stores lifting performance data 102A and performance region data 102B of the work machine 1. In the lifting performance data 102A, the lifting performance is set for each operation state. The operation state includes the boom length of the telescopic boom 17, the derricking angle of the telescopic boom 17, a slewing angle, an actual load, an overhanging state of the outrigger, the work radius, the weight of the counter weight C/W attached to a slewing base 11, and an attachment device. In the performance region data 102B, there is set a switching angle which defines a performance region which includes a front region, a back region, and a side region. The lifting performance data 102A and the performance region data 102B are referred when the processing unit 101 performs the overload preventing process.

Further, the lifting performance data 102A and the performance region data 102B may be stored in the ROM (not illustrated) of the processing unit 101. The lifting performance data 102A and the performance region data 102B are provided through, for example, a computer-readable portable recording medium (including an optical disk, a magneto-optical disk, and a memory card) where the data is stored. In addition, for example, the lifting performance data 102A and the performance region data 102B may be provided by being downloaded from a server which holds the data through a network. In addition, the lifting performance data 102A and the performance region data 102B may be generated by an external computer in advance in a stage of manufacturing the work machine 1, and may be stored in the storage unit 102, or may be updated appropriately. Further, the lifting performance data 102A and the performance region data 102B may be generated by the processing unit 101, or may be stored in the storage unit 102 or the ROM (not illustrated) of the processing unit 101. The details of the lifting performance data 102A and the performance region data 102B will be described later.

The boom length detection unit 111 detects the boom length of the telescopic boom 17, and outputs the detected boom length data to the processing unit 101.

The derricking angle detection unit 112 detects the derricking angle of the telescopic boom 17 with respect to the slewing surface of the upper slewing body 10, and outputs the detected derricking angle data to the processing unit 101.

The slewing angle detection unit 113 detects the slewing angle of the upper slewing body 10 (the forward direction of the work machine 1 is set to a reference angle of 0°), and outputs the detected slewing angle data to the processing unit 101.

The load detection unit 114 detects the weight (the actual load including the weight of the hook 15) of a load hanged to the telescopic boom 17, and outputs the detected load data to the processing unit 101.

The outrigger overhang width detection unit 115 detects the overhanging states of the outriggers OR1 to OR4, and outputs overhanging state data to the processing unit 101.

The processing unit 101 acquires the present operation state of the work machine 1 on the basis of the detection data acquired from the boom length detection unit 111, the derricking angle detection unit 112, the slewing angle detection unit 113, the load detection unit 114, and the outrigger overhang state detection unit 115. In addition, the processing unit 101 reads the lifting performance corresponding to the present operation state from the lifting performance data and the performance region data, and monitors a load state (load rate), and notifies the load state on the basis of the read lifting performance and the actual load. Further, the processing unit 101 issues a warning through the display unit 122 and/or the voice output unit 123 in a case where the work machine 1 is in an attentional state or a dangerous state, and controls a derricking operation and a slewing operation of the work machine 1.

The operation unit 121 includes an operation lever, a steering wheel, a pedal, and switches to perform the travelling operation (for example, steering of the front wheel 22 and the rear wheel 23) and the crane operation (for example, derricking and stretching of the telescopic boom 17). For example, the operation unit 121 is used when an operator inputs the operation state of the work machine 1 and changes the setting of the overload preventing device 100. In addition, if the crane operation is performed by the operator through the operation unit 121, the processing unit 101 (the drive control unit 101D) outputs a control signal corresponding to the operator's operation to the hydraulic system 124.

Figure 6:
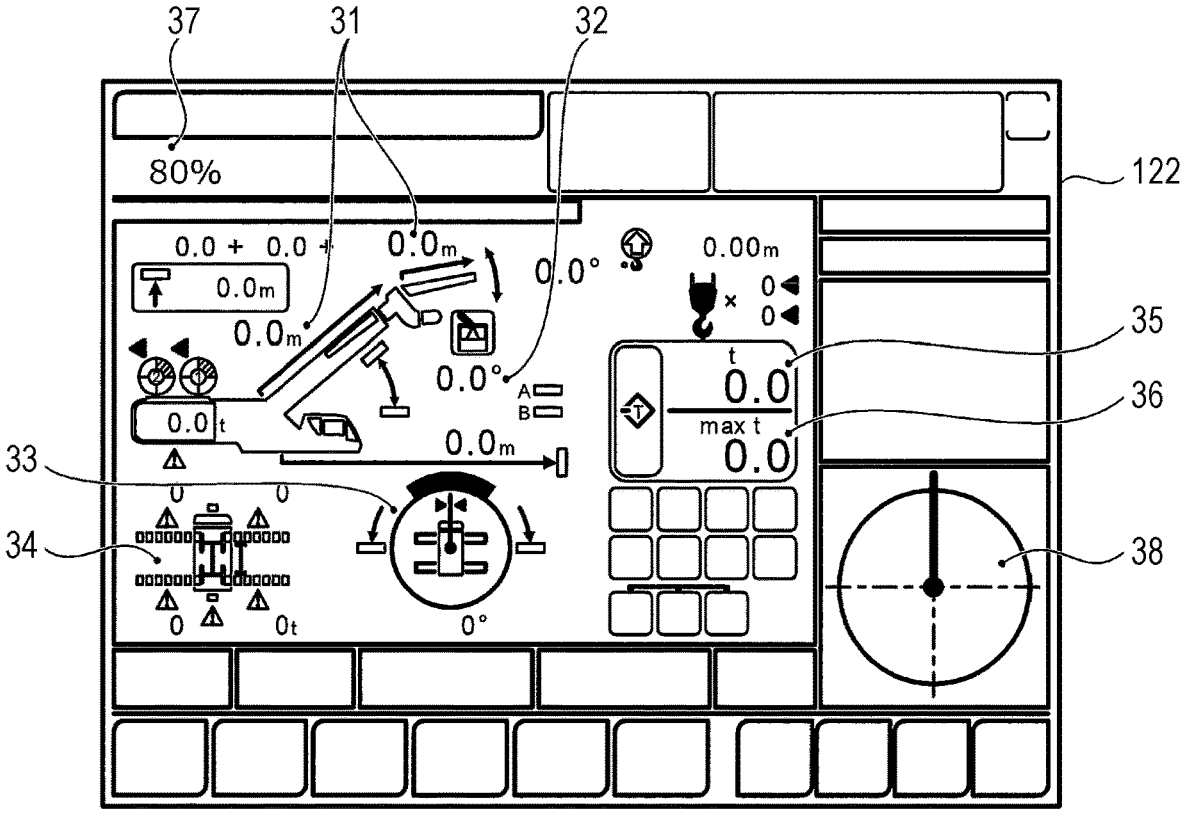
FIG. 6 is a diagram illustrating a display example in a display unit.

The display unit 122 is configured by, for example, a flat panel display such as a liquid crystal display and an organic EL display. The display unit 122 displays information indicating the operation state of the work machine 1 according to the control signal from the processing unit 101 (the display/voice control unit 101E) (see FIG. 6). As illustrated in FIG. 6, the information indicating the operation state includes lengths 31 of the telescopic boom 17 and the jib 14, a derricking angle 32 of the telescopic boom 17, a slewing angle 33 of the upper slewing body 10, an overhanging state 34 of the outriggers OR1 to OR4, an actual load 35, the present lifting performance 36, the present load rate 37, the lifting performance corresponding to the operation state, and a lifting performance chart 38 indicating the performance region. The operator mainly refers the information displayed in the display unit 122 when operating the crane.

Further, the operation unit 121 and the display unit 122 may be integrally configured by a flat panel display equipped with a touch panel. In addition, the display unit 122 includes a Light Emitting Diode (LED), and may notify the load state of the work machine 1 by turning on or blinking the LED.

The voice output unit 123 is configured by, for example, a speaker. The voice output unit 123 outputs a voice (for example, a warning buzzer) indicating the load state of the work machine 1 according to the control signal from the processing unit 101 (the display/voice control unit 101E).

The hydraulic system 124 operates various drive units (hydraulic cylinder etc.) of the work machine 1 according to the control signal from a processing unit 131 (the drive control unit 101D).

Figure 7:
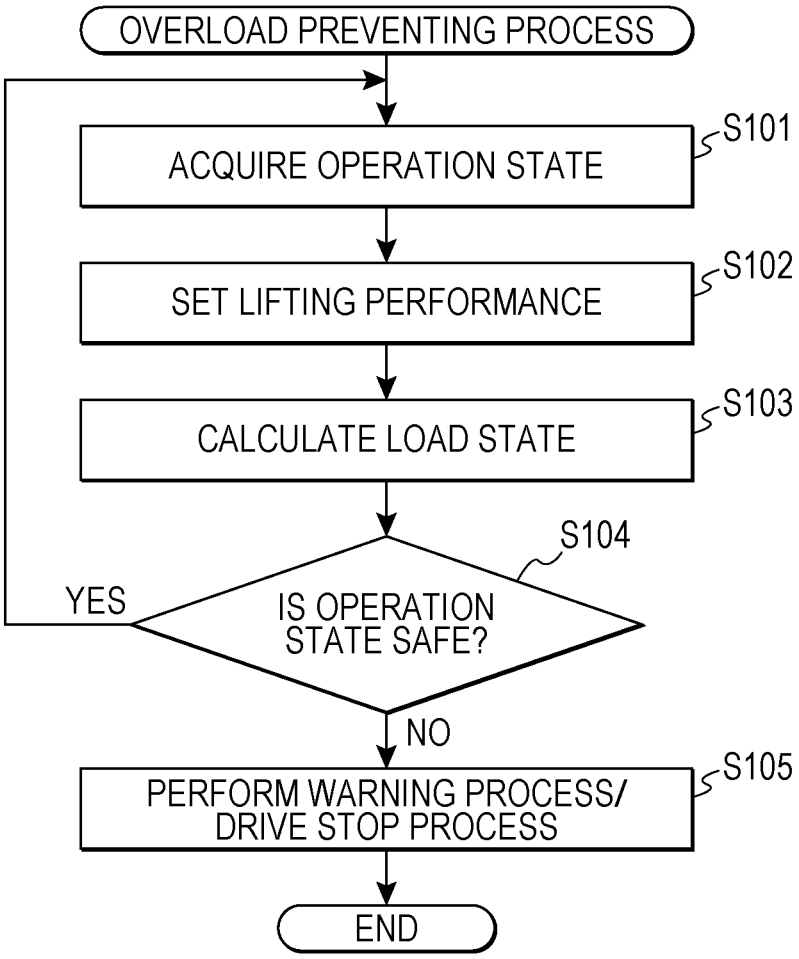
FIG. 7 is a flowchart illustrating an example of an overload preventing process.

FIG. 7 is a flowchart illustrating an example of the overload preventing process by the processing unit 101. This process is realized by, for example, executing the overload preventing program which is stored in the ROM (not illustrated) by the CPU (not illustrated) as the engine of the work machine 1 is activated.

In Step S101, the processing unit 101 acquires the operation state of the work machine 1 from the detection units 111 to 115 (the process as the operation state acquisition unit 101A). In addition, the processing unit 101 calculates the present work radius on the basis of the boom length of the telescopic boom 17 and the derricking angle. The processing unit 101 displays the acquired or calculated information to the display unit 122 (the process as the display/voice control unit 101E, see FIG. 6).

In Step S102, the processing unit 101 reads the lifting performance corresponding to the present operation state (for example, the boom length of the telescopic boom 17, the work radius, and the overhanging state of the outrigger) from the lifting performance data and the performance region data, and performs setting (the process as the lifting performance setting unit 101B). In addition, the processing unit 101 displays the lifting performance chart 38 indicating the lifting performance in all circumferential directions (see FIG. 6) and the lifting performance 36 corresponding to the present operation state (including the slewing angle) (see FIG. 6) to the display unit 122 (the process as the display/voice control unit 101E).

Figure 1:
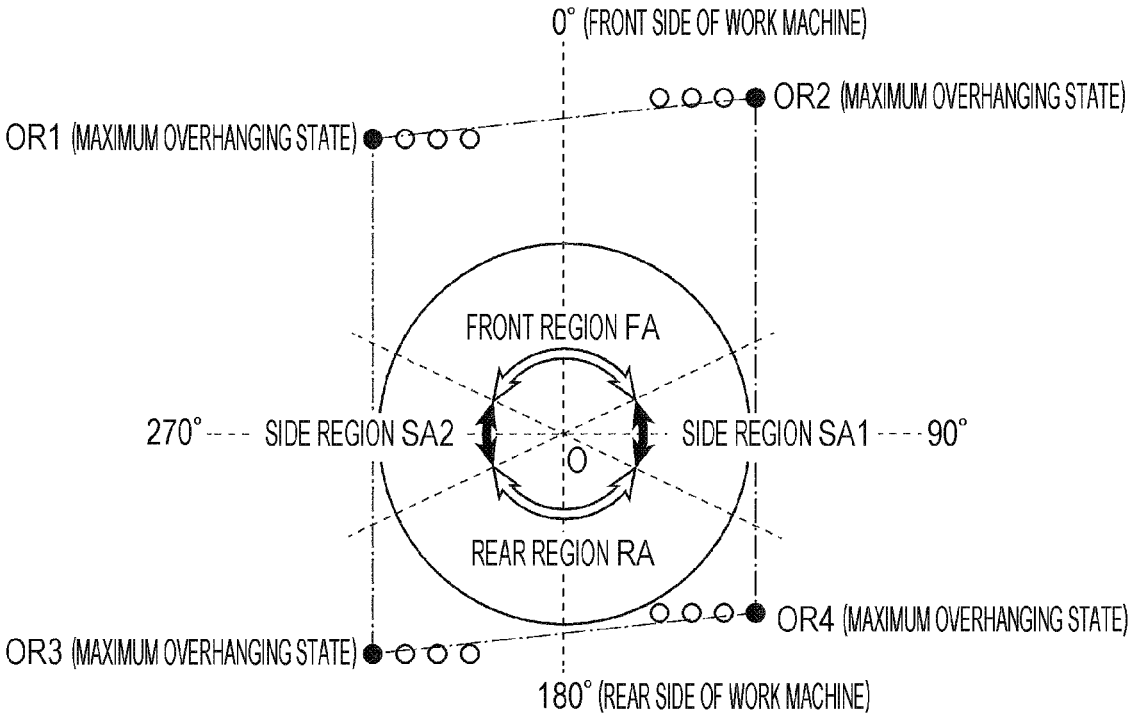
FIG. 1 is a diagram illustrating an example (equal overhanging state) of a lifting performance of a work machine which is set by a conventional method.
Figure 2A:
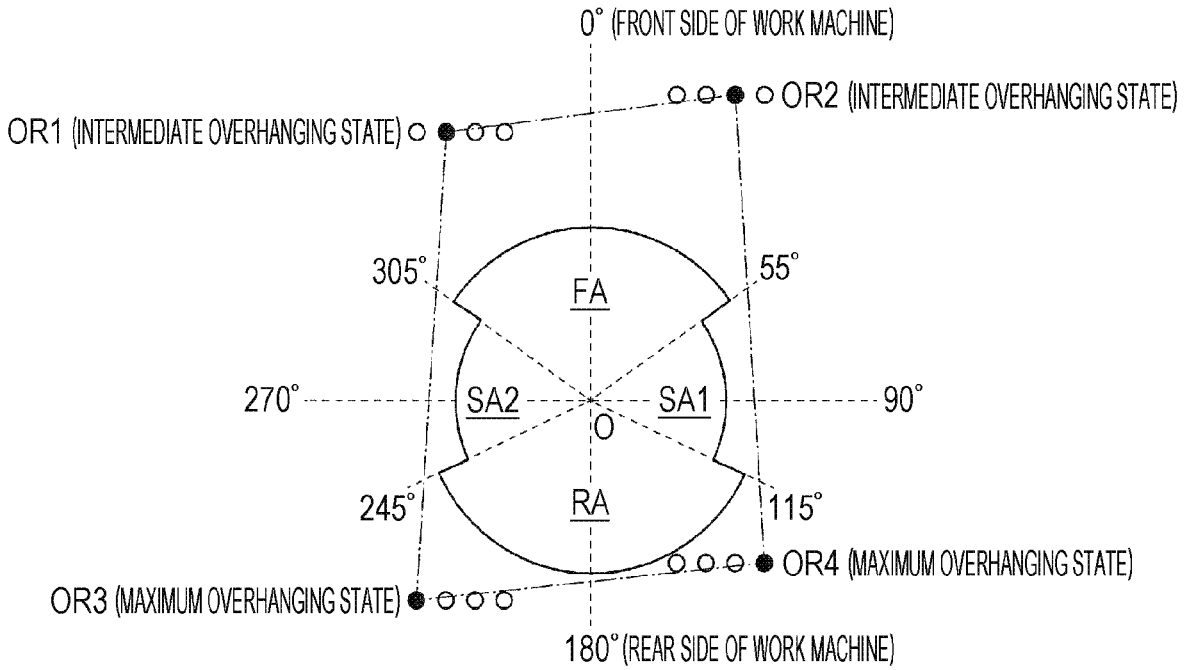
FIGS. 2A and 2B are diagrams illustrating other examples (different states) of the lifting performance of the work machine which is set by the conventional method.
Figure 2B:
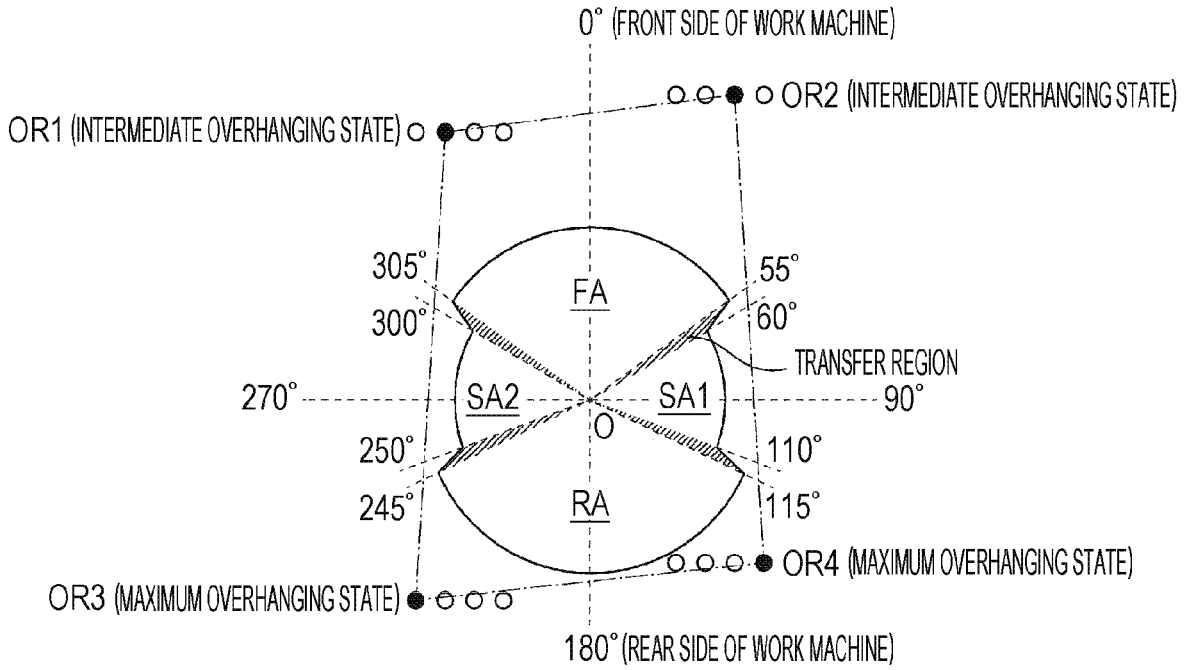

Specifically, in a case where all the outriggers OR1 to OR4 are in a maximum overhanging state, a maximum overhanging performance can be set for the front region, the back region, and the side region, that is, all circumferential directions. The lifting performance chart 38 is displayed as illustrated in FIG. 1 for example.

Further, the front region and the back region may include a reference performance region where stability is equal to or more than a predetermined value and a specific performance region which is larger than the reference performance region according to a gravity center position of the work machine 1. The reference performance region and the specific performance region are set on the basis of the jack reaction of the outriggers OR1 to OR4. A maximum overhanging width performance corresponding to the reference performance region is referred to as "standard performance", and a maximum overhanging width performance corresponding to the specific performance region is referred to as "special performance". The switching angle θ of the performance region data includes the switching angle within a region where the reference performance region and the specific performance region are defined. The reference performance region and the specific performance region are defined on the basis of the performance region data (the switching angle within the region) corresponding to the operation state.

On the other hand, in a case where the outriggers OR1 to OR4 are in different states, the front region, the back region, and the side region (including the transition region) are defined on the basis of the performance region data (a first switching angle θ1, a second switching angle θ2) corresponding to the operation state. The lifting performance (a first lifting performance; herein, the maximum overhanging width performance) in the front region and the back region, the lifting performance (a second lifting performance; herein, an intermediate overhanging width performance or a minimum overhanging width performance) in the side region (except the transition region), and the lifting performance (third lifting performance) in the transition region are set. The lifting performance in the transition region is calculated on the basis of interpolation data which is included in the lifting performance data. The first switching angle θ1 included in the performance region data is a slewing angle at which the front region and the side region (transition region) are switched. The second switching angle θ2 is a slewing angle at which the transition region in the side region and a fixed region are switched.

In Step S103, the processing unit 101 calculates the present load rate (load rate) on the basis of the present lifting performance and the actual load, and displays the present load rate 37 (see FIG. 6) in the display unit 122 (processes of the load state determination unit 101C and the display/voice control unit 101E). Further, the load state may be calculated using the present lifting performance (rated total load) and the actual load, or may be calculated using a rated moment and an operation moment corresponding thereto.

In Step S104, the processing unit 101 determines whether the operation state of the work machine 1 is safe on the basis of the present load state. In a case where the present load state is equal to or less than a predetermined acceptable value, the processing unit 101 determines that the state is safe. In a case where the operation state of the work machine 1 is safe ("YES" in Step S104), the procedure proceeds to the process of Step S101. Then, the load state is monitored according to a change in the operation state. On the other hand, in a case where the operation state of the work machine 1 is not safe ("NO" in Step S104), the procedure proceeds to the process of Step S105.

In Step S105, the processing unit 101 performs a process according to the load state of the work machine 1. Specifically, in a case where the present load state is the attentional state, the processing unit 101 displays the fact to the display unit 122, and outputs a warning buzzer through the voice output unit 123 (the process as the display/voice control unit 101E). In addition, in a case where the present load state is the dangerous state, the processing unit 101 displays the fact to the display unit 122, outputs a warning buzzer through the voice output unit 123 (the process as the display/voice control unit 101E). Further, the processing unit 101 outputs the control signal to the hydraulic system 124 to slowly stop the operation of the work machine 1 (for example, the derricking operation or the slewing operation of the telescopic boom 17) (the process as the drive control unit 101D). Further, the display content of the display unit 122 and the voice content of the voice output unit 123 in the attentional state are different from the display content and the voice content in the dangerous state. In addition, a determination value (first load rate) for determining the attentional state is smaller than a determination value (second load rate) for determining the dangerous state.

The safety of the work machine 1 is secured by the above overload preventing process. The overload preventing process described above ends as the engine of the work machine 1 stops.

In this embodiment, the switching angle (including the switching angle within the region) of the performance region data is set on the basis of the stability calculation and the strength factor (jack strength etc.) for each operation state. Conventionally, the switching angle of the performance region data depends on the overhanging states of the outriggers OR1 to OR4. However, in this embodiment, the switching angle is set in consideration of not only the overhanging states of the outriggers OR1 to OR4 but also the operation state. Herein, the description will be given about a case where the switching angle is set for each combination of the boom length L of the telescopic boom 17 and the weight W of the counter weight C/W.

FIGS. 8A to 8D are diagrams illustrating the lifting performance in all circumferential directions in a case where the switching angle of performance region data is set in consideration of the boom length L of the telescopic boom 17 and the weight W of a counter weight C/W. FIGS. 8A to 8D illustrate a case where the outriggers OR1 and OR2 of the front side are in the first intermediate overhanging state, and the outriggers OR3 and OR4 of the rear side are in the maximum overhanging state. In addition, in FIGS. 8A to 8D, the boom length L is denoted by "Boom: Short" in the case of Fully contracted state≤L<X[m], "Boom: Long" in the case of X[m]≤L<Fully stretched state. The weight of the counter weight C/W is denoted by "C/W: Large" in the case of Y[ton]≤W<Maximum weight, and "C/W: Small" in the case of Minimum weight≤W<Y[ton].

FIGS. 8A to 8D illustrate cases where a combination (W/L) of the weight W of the counter weight C/W and the boom length L of the telescopic boom 17 is (Large/Short), (Small/Short), (Large/Long), and (Small/Long).

Figure 8A:
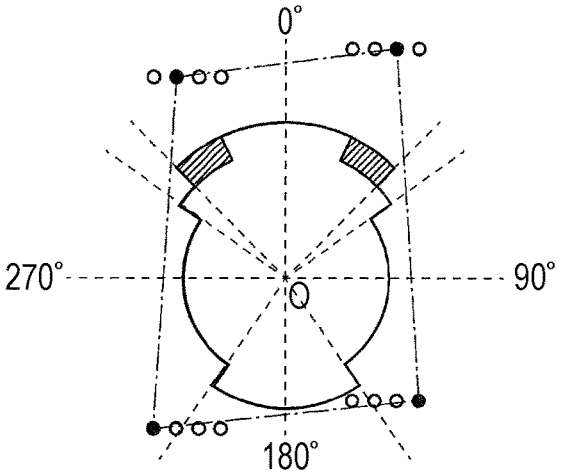
FIGS. 8A to 8D are diagrams illustrating the lifting performance in all circumferential directions in a case where the switching angle of performance region data is set in consideration of a boom length of a telescopic boom and a weight of a counter weight.
Figure 8B:
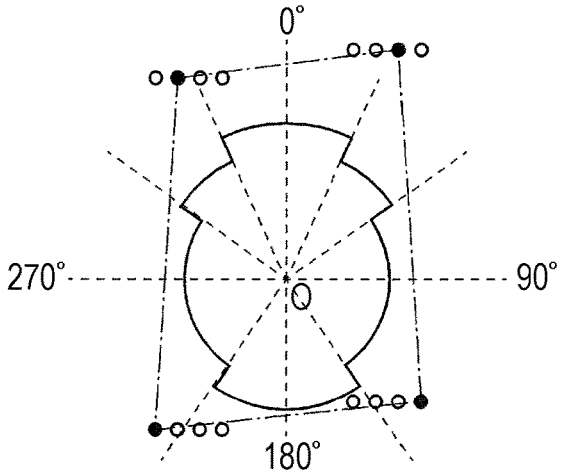

In the pattern illustrated in FIG. 8B among four patterns of FIGS. 8A to 8D, the performance region is smallest. The performance region illustrated in FIG. 8B is similar to a case where the switching angle is set in the conventional method. With this regard, in the patterns illustrated in FIGS. 8A, 8C, and 8D, the performance region is expanded by the inclined portion.

Figure 8C:
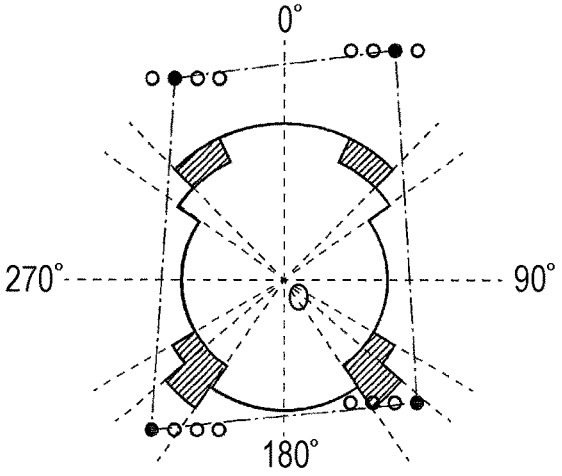
Figure 8D:
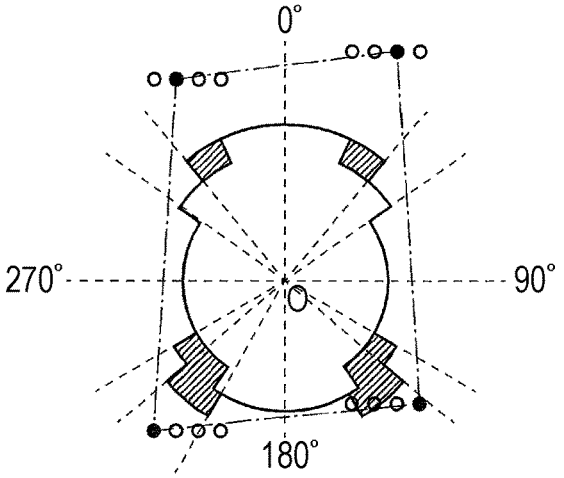

Specifically, in a case where the weight W of the counter weight C/W is large (FIGS. 8A and 8C), the weight of the work machine 1 is increased compared to a case where the weight is small (FIGS. 8B and 8D), and the stability moment is increased. Therefore, the stable is increased. As the stability is increased, the specific performance region of the front region can be expanded. In addition, in a case where the boom length L is long (FIGS. 8C and 8D), the rated total load determined by the strength and the stability is reduced compared to a case where the boom length is short (FIGS. 8A and 8B). Therefore, if the work radiuses are the same, the weight of the entire work machine when the rated total load is lifted is small in a case where the boom length L is long, and the influence on the jack reaction is also reduced. Therefore, in a case where the boom length L is long, the performance region can be set widely compared to a case where the boom length L is short. Specifically, as illustrated in FIGS. 8C and 8D, the reference performance region in the back region can be expanded according to the stability and the magnitude of the jack reaction, and the specific performance region can be added. In this way, in FIG. 8A, the influence of the jack reaction of the front outrigger OR1 is improved. In FIGS. 8C and 8D, the influence of the jack reactions of the outriggers OR3 and RO4 of the rear side are improved.

By the way, in the related art, a two-dimensional coordinate system in which the slewing angle is a circumferential direction and the lifting performance is a radius direction is used in the lifting performance chart indicating the lifting performance corresponding to the operation state as illustrated in FIGS. 1, 2A, 2B, and 8A to 8D. However, in the lifting performance chart using the two-dimensional coordinates system, the change in work radius and the change in lifting performance is inversed (for example, if the work radius increases, the lifting performance is reduced). Therefore, it is hard to grasp the change in lifting performance according to the change in work radius.

Figure 9A:
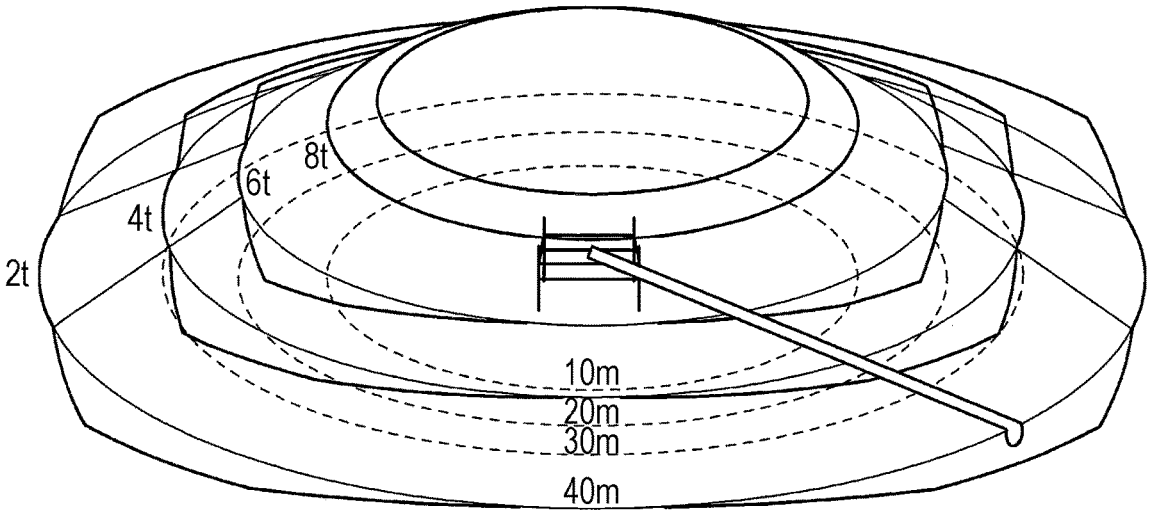
FIGS. 9A and 9B are diagrams illustrating an example of a lifting performance chart in which a cylindrical coordinates system is used.
Figure 9B:
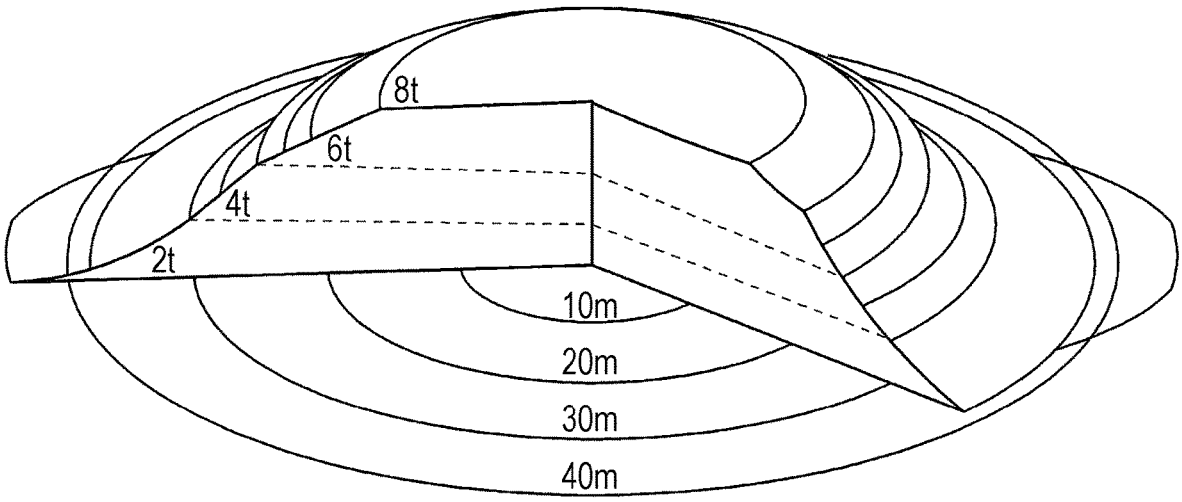

Then, in this embodiment, there is used a cylindrical coordinates system in which the slewing angle is a circumferential direction, the work radius is a radius direction, and the lifting performance is the axial direction. FIGS. 9A and 9B are diagrams illustrating examples of the lifting performance chart in which the cylindrical coordinates system is used. In FIG. 9B, part in FIG. 9A is removed. As illustrated in FIGS. 9A and 9B, according to the lifting performance chart using the cylindrical coordinates system, the change in lifting performance according to the change in work radius and/or slewing angle can be visually grasped, so that the working efficiency and the safety are improved. In particular, it is effective in a case where the lifting performance changes according to the slewing angle.

In this way, the overload preventing device 100 according to this embodiment is mounted in the work machine 1 (mobile work machine) which includes the freely-operating lower travelling body 20, the slewing base 11 disposed on the lower travelling body 20 to slewing horizontally, the telescopic boom 17 disposed on the slewing base 11 to be derricked, and the plurality of outriggers OR1 to OR4 capable of setting the overhanging width in plural stages.

The overload preventing device 100 includes the storage unit 102 which stores the lifting performance data with the lifting performance set for each operation state, the performance region data with the switching angle set to define the performance region which includes the front region, the back region, and the side region, and a work machine control unit which controls the operation of the work machine 1 on the basis of the lifting performance corresponding to the present operation state of the work machine 1 and the actual load.

The lifting performance includes the maximum overhanging width performance which is set to the front region and the back region. The switching angle is set on the basis of the strength factors such as the stability calculation and the jack strength for each operation state.

According to the overload preventing device 100, it is possible to allow maximum utilization of the performance of the work machine 1 in different states of the outriggers while ensuring stability.

Hitherto, the embodiments of the invention implemented by the inventor have been described specifically. However, the invention is not limited to the embodiments, and may be changed within a scope not departing from the spirit thereof.

For example, the invention may be applied to an overload preventing device which is mounted in a mobile work vehicle which is supported by the outriggers such as an all-terrain crane, a truck crane, or a high-place work vehicle.

In the embodiments, the processing unit 101 (computer) functions as the operation state acquisition unit 101A, the lifting performance setting unit 101B, the load state determination unit 101C, the drive control unit 101D, and the display/voice control unit 101E, so that the overload preventing device 100 according to the invention is realized. However, some of all of these functions may be configured by electronic circuits such as a Digital Signal Processor (DSP), an Application Specific Integrated Circuit (ASIC), and a Programmable Logic Device (PLD).

The embodiments of this disclosure should be considered to be illustrative in all respects and not restrictive. The scope of the invention is not described above but indicated by claims, and is intended to include the meanings equivalent to claims and all changes within the scope.

The entire contents of specification, drawings, and abstract contained in Japanese Patent Application No. 2017-153646, filed on Aug. 8, 2017 are incorporated herein.

REFERENCE SIGNS LIST

1 mobile work machine
10 upper slewing body
20 lower travelling body
100 overload preventing device
101 processing unit
101A operation state acquisition unit
101B lifting performance setting unit
101C load state determination unit
101D drive control unit
101E display/voice control unit
102 storage unit

The invention claimed is:

1. An overload preventing device which is mounted in a mobile work machine which includes a travelling body which travels freely, a slewing base disposed on the travelling body to slewing horizontally, a boom disposed on the slewing base to be derricked, and a plurality of outriggers capable of setting an overhanging width in plural stages, the overload preventing device comprising:

a storage unit which stores lifting performance data in which a lifting performance is set for each operation state and performance region data in which a switching angle is set to define a performance region which includes a front region, a back region, and a side region; and a work machine control unit which controls an operation of the mobile work machine on the basis of the lifting performance corresponding to a present operation state of the mobile work machine and an actual load, wherein the performance region is set corresponding to a slewing state of the slewing base within a horizontal plane, the front region is a performance region in front of the mobile work machine within the horizontal plane, the back region is a performance region on a rear side of the mobile work machine within the horizontal plane, the side region is a performance region other than the front region and the back region within the horizontal plane, the lifting performance includes a maximum overhanging width performance which is set to the front region and the back region, and the switching angle is set on the basis of a stability in all circumferential directions within the horizontal plane when the maximum overhanging width performance is loaded for each operation state.

2. The overload preventing device according to claim 1, wherein the work machine control unit switches the performance region according to the operation state of the mobile work machine.

3. The overload preventing device according to claim 1, wherein the operation state includes a boom length of the boom, a weight of a counter weight which is attached to the slewing base, and a type of an attachment device which is attached to the slewing base.

4. The overload preventing device according to claim 1, wherein the maximum overhanging width performance includes a first performance which is set to all circumferential directions, and a second performance which is larger than the first performance, and the switching angle includes a switching angle within a region where a first performance region in which the first performance is set in the front region or the back region, and a second performance region in which the second performance is set are defined.

5. The overload preventing device according to claim 1, further comprising:

a display control unit which displays information related to the operation state to a display unit of the mobile work machine, wherein the display control unit three-dimensionally displays a lifting performance chart generated on the basis of the lifting performance data and the performance region data using a cylindrical coordinates system in which a work radius is a radius direction, a slewing angle is a circumferential direction, and the lifting performance is an axial direction.

* * * * *